US010984713B1

(12) United States Patent
Tan et al.

(10) Patent No.: US 10,984,713 B1
(45) Date of Patent: Apr. 20, 2021

(54) EXTERNAL COMPENSATION FOR LTPO PIXEL FOR OLED DISPLAY

(71) Applicant: Apple Inc., Cupertino, CA (US)

(72) Inventors: Junhua Tan, Saratoga, CA (US); Chaohao Wang, Sunnyvale, CA (US); Jun Li, San Jose, CA (US); Myungjoon Choi, Sunnyvale, CA (US); Hyunsoo Kim, Mountain View, CA (US); Shengkui Gao, San Jose, CA (US); Injae Hwang, Cupertino, CA (US); Sun-Il Chang, San Jose, CA (US); Jie Won Ryu, Santa Clara, CA (US); Hyunwoo Nho, Palo Alto, CA (US); Shiping Shen, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/409,489

(22) Filed: May 10, 2019

Related U.S. Application Data

(60) Provisional application No. 62/669,903, filed on May 10, 2018.

(51) Int. Cl.
*G09G 3/3233* (2016.01)

(52) U.S. Cl.
CPC ... *G09G 3/3233* (2013.01); *G09G 2320/0233* (2013.01); *G09G 2320/0693* (2013.01)

(58) Field of Classification Search
CPC ..... G09G 3/3233; G09G 2320/0233; G09G 2320/0693
See application file for complete search history.

(56) References Cited

U.S. PATENT DOCUMENTS 8,058,808 B2 * 11/2011 Hong ..... G09G 3/3233 315/169.3
2009/0102749 A1 * 4/2009 Kawabe ..... G09G 3/3258 345/45
2009/0160740 A1 * 6/2009 Leon ..... G09G 3/3291 345/76
2009/0224016 A1 * 9/2009 Stautzenberger, Sr. ... B60R 9/00 224/571
2009/0225016 A1 * 9/2009 Lai ..... G09G 3/3406 345/87
2010/0103082 A1 * 4/2010 Levey ..... G09G 3/3233 345/76
2010/0103159 A1 * 4/2010 Leon ..... G09G 3/3233 345/212
2010/0225630 A1 * 9/2010 Levey ..... G09G 3/3233 345/211
2010/0225634 A1 * 9/2010 Levey ..... G09G 3/3208 345/212
2010/0238356 A1 * 9/2010 Kida ..... G09G 5/00 348/618

(Continued)

*Primary Examiner* — Grant Sitta
(74) *Attorney, Agent, or Firm* — Fletcher Yoder, P.C.

(57) ABSTRACT

An electronic display system may include a display panel used to display an image through emitting light. The electronic display system may also include processing circuitry that receives indication of an image to be displayed on the display panel and generates one or more signals to communicate the image on the display panel. The processing circuitry may compensate for non-uniformities in light emission between pixels of the display due to current-voltage non-uniformities.

20 Claims, 9 Drawing Sheets

(56) References Cited

U.S. PATENT DOCUMENTS

2011/0069061 A1* 3/2011 Nakamura ..... G09G 3/006 345/214
2011/0227505 A1* 9/2011 Park ..... H05B 45/60 315/297
2012/0056916 A1* 3/2012 Ryu ..... G09G 5/10 345/691
2013/0027383 A1* 1/2013 Odawara ..... G09G 3/3233 345/212
2014/0239846 A1* 8/2014 Shoji ..... H05B 45/60 315/297
2014/0354711 A1* 12/2014 In ..... G09G 3/3233 345/691
2016/0035281 A1* 2/2016 Jeon ..... G09G 3/006 345/690
2016/0086548 A1* 3/2016 Maeyama ..... G09G 3/3258 345/690
2017/0039953 A1* 2/2017 Lee ..... G09G 3/3233
2017/0132977 A1* 5/2017 Kim ..... G09G 3/3266
2017/0287390 A1* 10/2017 Lee ..... G09G 3/3233
2017/0365202 A1* 12/2017 Lin ..... G09G 3/3258
2018/0075798 A1* 3/2018 Nho ..... G09G 3/32
2018/0077314 A1* 3/2018 Nishi ..... H04N 1/32545
2018/0090109 A1* 3/2018 Lin ..... G09G 3/2096
2018/0130423 A1* 5/2018 Kim ..... G09G 3/3233
2018/0137819 A1* 5/2018 An ..... G09G 3/3233
2018/0137825 A1* 5/2018 An ..... G09G 3/3266
2018/0151112 A1* 5/2018 Song ..... G09G 3/3283
2018/0151124 A1* 5/2018 An ..... G09G 3/3291
2018/0182303 A1* 6/2018 Jung ..... G09G 3/3291
2019/0147781 A1* 5/2019 Park ..... G09G 3/3233 345/691
2019/0156717 A1* 5/2019 Moradi ..... G09G 3/3233
2019/0156718 A1* 5/2019 Moradi ..... G09G 3/006

* cited by examiner

EXTERNAL COMPENSATION FOR LTPO PIXEL FOR OLED DISPLAY

CROSS REFERENCE TO RELATED APPLICATION

This application claims priority to U.S. Provisional Patent Application No. 62/669,903, entitled "EXTERNAL COMPENSATION FOR LTPO PIXEL FOR OLED DISPLAY," filed May 10, 2018, which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Methods and systems for compensating for non-uniformities between pixels of an electronic display may substantially improve the visual appearance of an electronic display by reducing perceivable visual artifacts. The systems to perform the compensation may be outside of an electronic display and/or an active area of the electronic display, in which case they may be understood to provide a form of external compensation, or the systems to perform the compensation may be located within the electronic display. The compensation may take place in a digital domain or an analog domain, the net result producing an adjusted electrical signal transmitted to each pixel of the electronic display before the electrical signal is used to cause the pixel to emit light. Because the adjusted electrical signal has been compensated to account for the non-uniformities of the pixels, the images resulting from the signals to the pixels may have substantially reduced visual artifacts. In some cases, visual artifacts due to pixel non-uniformities may be reduced or eliminated.

Indeed, this disclosure describes compensation techniques that use a per-pixel function to leverage a relatively small number of variables to predict a current versus voltage relationship (I-V curve) of a pixel, subsequently decreasing, or eliminating, a reliance on actual performance data to generate the I-V curves. The predicted I-V curve may facilitate determining an electrical signal to transmit to the pixel to elicit emission of a target brightness of light, or a defined gray level within a range of possible gray levels indicating the target brightness of light, based on the specific properties of the pixel. In addition, some embodiments may include a regional or global adjustment function to further correct non-uniformities of the electronic display. A controller may apply these functions to improve perceivable visual appearances of the electronic display by adjusting an electrical signal used to drive a pixel. The per-pixel function may facilitate in reducing non-uniformity between pixels, while the regional or global adjustment function may facilitate in reducing non-uniformity between regions of the electronic display, where one or both non-uniformities may be caused at least in part by temperature differences affecting component performance, manufacturing differences, spatial frequency errors, component aging difference, and the like.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
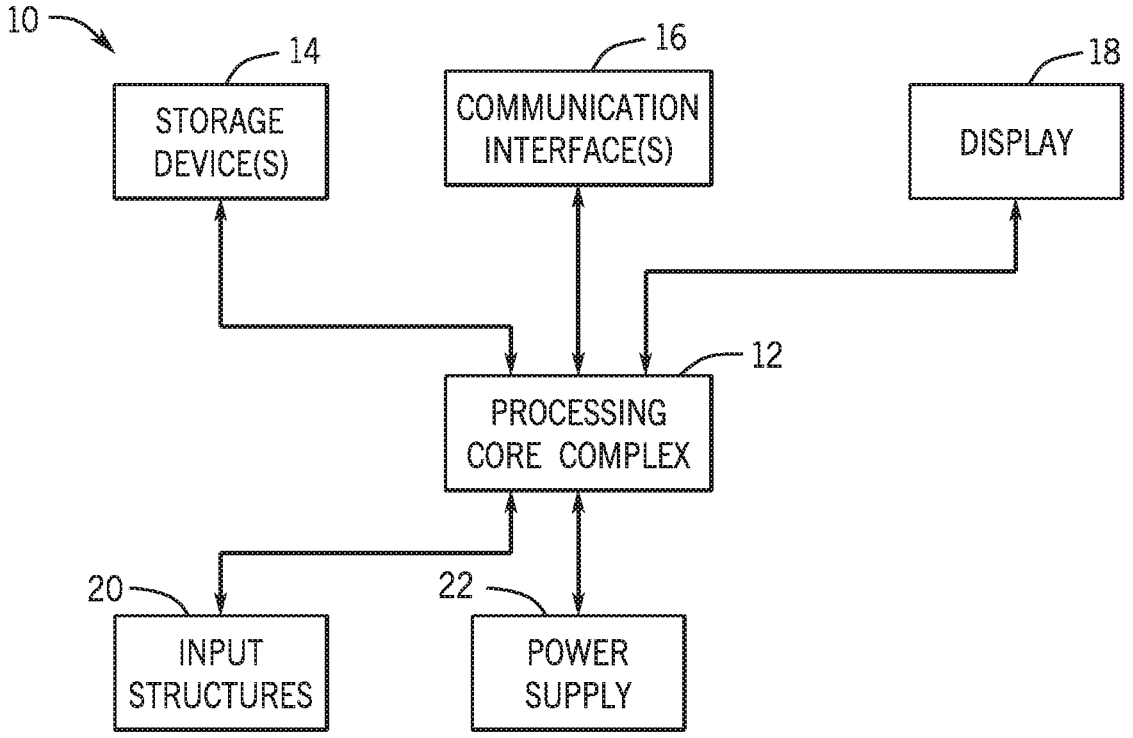
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual embodiment, as in any engineering or design project, numerous embodiment-specific decisions are be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to systems and methods for compensating non-uniformities between pixels of an electronic display to improve perceived appearances of visual artifacts. Electronic displays are found in numerous electronic devices, from mobile phones to computers, televisions, automobile dashboards, and many more. Individual pixels of the electronic display may collectively produce images by permitting different amounts of light to be emitted from each pixel. This may occur by self-emission as in the case of light-emitting diodes (LEDs), such as organic light-emitting diodes (OLEDs), or by selectively providing light from another light source as in the case of a digital micromirror device or liquid crystal display. These electronic displays sometimes do not emit light equally between portions or between pixels of the electronic display, for example, due at least in part to pixel non-uniformity caused by differences in component age, operating temperatures, material properties of pixel components, and the like. The non-uniformity between pixels and/or portions of the electronic display may manifest as visual artifacts as different pixels or areas of the electronic display emit visibly different amounts of light. While this disclosure will generally refer to self-emissive displays, it should be appreciated that the systems and methods of this disclosure may also apply to other forms of electronic display that have non-uniform pixels having varying I-V curves, and should not be understood to be limited to self-emissive displays. When the electronic display is a self-emissive display, an OLED represents one type of LED that may be found in a self-emissive pixel, but other types of LEDs may also be used.

The systems and methods of this disclosure may compensate for non-uniformities, or non-uniform properties, between pixels. This may improve the visual appearance of images on the electronic display and may improve a response by the electronic display to changes in operating conditions, such as temperature, by enabling a controller to accurately predict performance of individual pixels of the electronic display without tracking and recording numerous data points of pixel behavior to determine voltage-to-current relationships (I-V curves). Instead, a controller may store a few variables for each pixel that, when used in a function, may generally produce the I-V curve of each respective pixel. This reduces a reliance on large numbers of stored data points for all of the pixels of the electronic display, saving memory and/or computing resources. Because the controller may use a relatively small number of per-pixel variables, however, a further compensation may be applied on a regional or global basis. By implementing the per-pixel function and the regional or global adjustment function, the I-V curves for each pixel in the electronic display may be estimated without relying on large amounts of stored test data. Using the estimated I-V curves defined by the per-pixel function and the regional or global compensation, image data that is to be displayed on the electronic display may be adjusted before it is programmed into each pixel. The resulting images may have reduced or eliminated visual artifacts due to I-V non-uniformities among the pixels.

A general description of suitable electronic devices that may include a self-emissive display, such as a LED (e.g., an OLED) display, and corresponding circuitry of this disclosure are provided. An OLED represents one type of LED that may be found in the self-emissive pixel, but other types of LEDs may also be used.

To help illustrate, an electronic device 10 including a display 18 is shown in FIG. 1. As is described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular implementation and is intended to illustrate the types of components that may be present in an electronic device 10. The electronic device 10 may include, among other things, a processing core complex 12 such as a system on a chip (SoC) and/or processing circuit(s), storage device(s) 14, communication interface(s) 16, the display 18, input structures 20, and a power supply 22. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components.

As depicted, the processing core complex 12 is operably coupled with the storage device(s) 14. Thus, the processing core complex 12 execute instructions stored in the storage device(s) 14 to perform operations, such as generating and/or transmitting image data. As such, the processing core complex 12 may include one or more general purpose microprocessors, one or more application specific integrated circuits (ASICs), one or more field programmable logic arrays (FPGAs), or any combination thereof.

In addition to instructions, the storage device(s) 14 may store data to be processed by the processing core complex 12. Thus, in some embodiments, the storage device(s) 14 may include one or more tangible, non-transitory, computer-readable mediums. The storage device(s) 14 may be volatile and/or non-volatile. For example, the storage device(s) 14 may include random access memory (RAM) and/or read only memory (ROM), rewritable non-volatile memory such as flash memory, hard drives, optical discs, and/or the like, or any combination thereof.

As depicted, the processing core complex 12 is also operably coupled with the communication interface(s) 16. In some embodiments, the communication interface(s) 16 may facilitate communicating data with another electronic device and/or a network. For example, the communication interface(s) 16 (e.g., a radio frequency system) may enable the electronic device 10 to communicatively couple to a personal area network (PAN), such as a Bluetooth network, a local area network (LAN), such as an 1622.11x Wi-Fi network, and/or a wide area network (WAN), such as a 4G or Long-Term Evolution (LTE) cellular network.

Additionally, as depicted, the processing core complex 12 is also operably coupled to the power supply 22. In some embodiments, the power supply 22 may provide electrical power to one or more components in the electronic device 10, such as the processing core complex 12 and/or the display 18. Thus, the power supply 22 may include any suitable source of energy, such as a rechargeable lithium polymer (Li-poly) battery and/or an alternating current (AC) power converter.

As depicted, the electronic device 10 is also operably coupled with the one or more input structures 20. In some embodiments, an input structure 20 may facilitate user interaction with the electronic device 10, for example, by receiving user inputs. Thus, the input structures 20 may include a button, a keyboard, a mouse, a trackpad, and/or the like. Additionally, in some embodiments, the input structures 20 may include touch-sensing components in the display 18. In such embodiments, the touch sensing components may receive user inputs by detecting occurrence and/or position of an object touching the surface of the electronic display 18.

In addition to enabling user inputs, the display 18 may include a display panel with one or more display pixels. As described above, the display 18 may control light emission from the display pixels to present visual representations of information, such as a graphical user interface (GUI) of an operating system, an application interface, a still image, or video content, by displaying frames based at least in part on corresponding image data. As depicted, the display 18 is operably coupled to the processing core complex 12. In this manner, the display 18 may display frames based at least in part on image data generated by the processing core complex 12. Additionally or alternatively, the display 18 may display frames based at least in part on image data received via the communication interface(s) 16 and/or the input structures 20.

Figure 2:
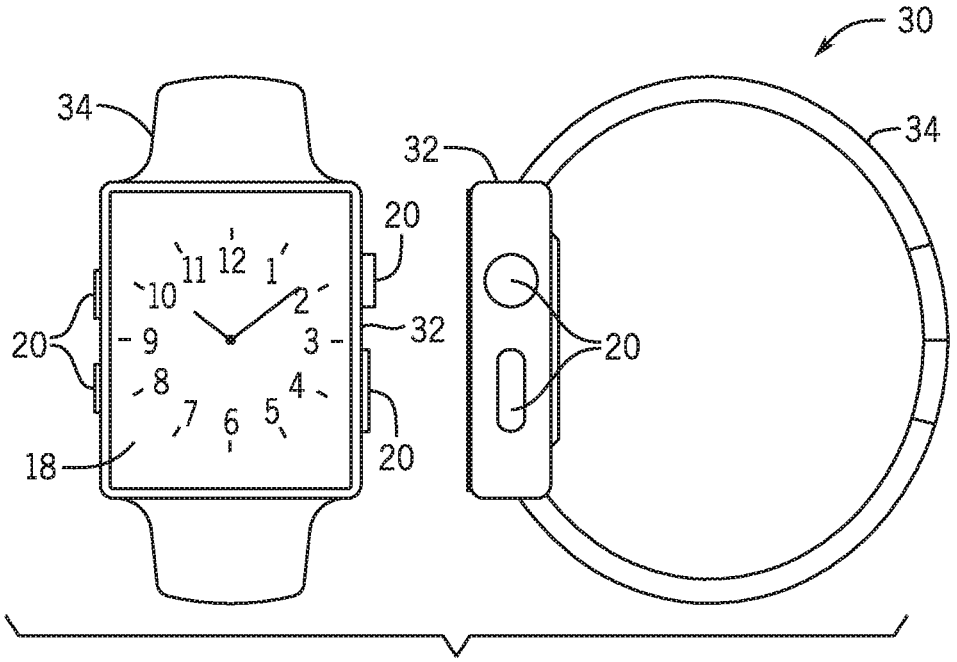
FIG. 2 is a perspective view of a watch representing an embodiment of the electronic device of FIG. 1, in accordance with an embodiment.

As may be appreciated, the electronic device 10 may take a number of different forms. As shown in FIG. 2, the electronic device 10 may take the form of a watch 30. For illustrative purposes, the watch 30 may be any Apple Watch® model available from Apple Inc. As depicted, the watch 30 includes an enclosure 32 (e.g., housing). In some embodiments, the enclosure 32 may protect interior components from physical damage and/or shield them from electromagnetic interference (e.g., house components). A strap 34 may enable the watch 30 to be worn on the arm or wrist. The display 18 may display information related to the operation of the watch 30. Input structures 20 may enable the user to activate or deactivate watch 30, navigate a user interface to a home screen, navigate a user interface to a user-configurable application screen, activate a voice-recognition feature, provide volume control, and/or toggle between vibrate and ring modes. As depicted, the input structures 20 may be accessed through openings in the enclosure 32. In some embodiments, the input structures 20 may include, for example, an audio jack to connect to external devices.

Figure 3:
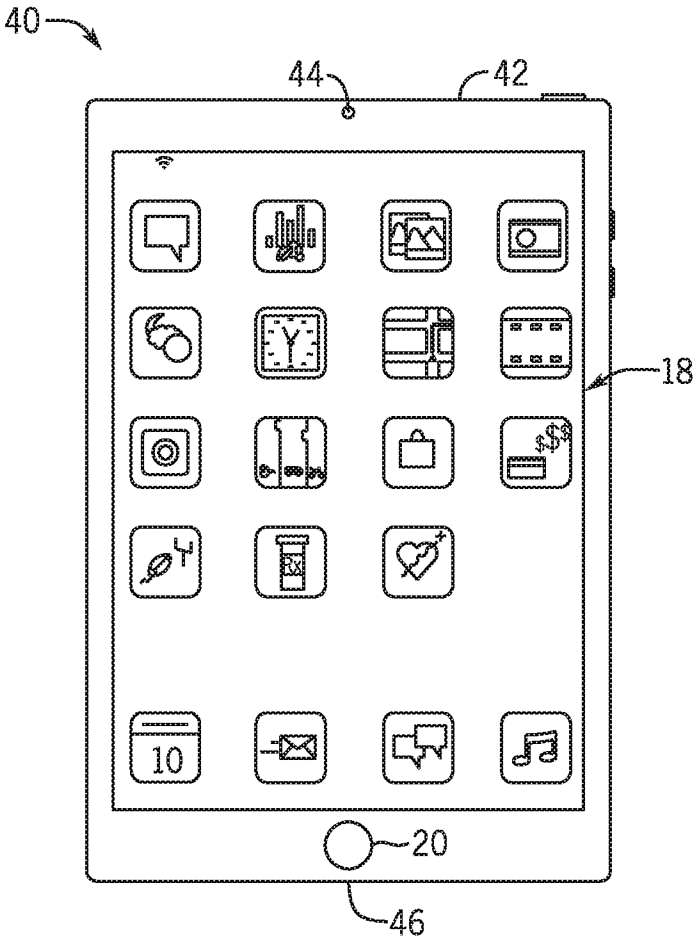
FIG. 3 is a front view of a tablet device representing an embodiment of the electronic device of FIG. 1, in accordance with an embodiment.

The electronic device 10 may also take the form of a tablet device 40, as shown in FIG. 3. For illustrative purposes, the tablet device 40 may be any iPad® model available from Apple Inc. Depending on the size of the tablet device 40, the tablet device 40 may serve as a handheld device such as a mobile phone. The tablet device 40 includes an enclosure 42 through which input structures 20 may protrude. In certain examples, the input structures 20 may include a hardware keypad (not shown). The enclosure 42 also holds the display 18. The input structures 20 may enable a user to interact with a GUI of the tablet device 40. For example, the input structures 20 may enable a user to type a Rich Communication Service (RCS) message, a Short Message Service (SMS) message, or make a telephone call. A speaker 44 may output a received audio signal and a microphone 46 may capture the voice of the user. The tablet device 40 may also include a communication interface 16 to enable the tablet device 40 to connect via a wired connection to another electronic device.

Figure 4:
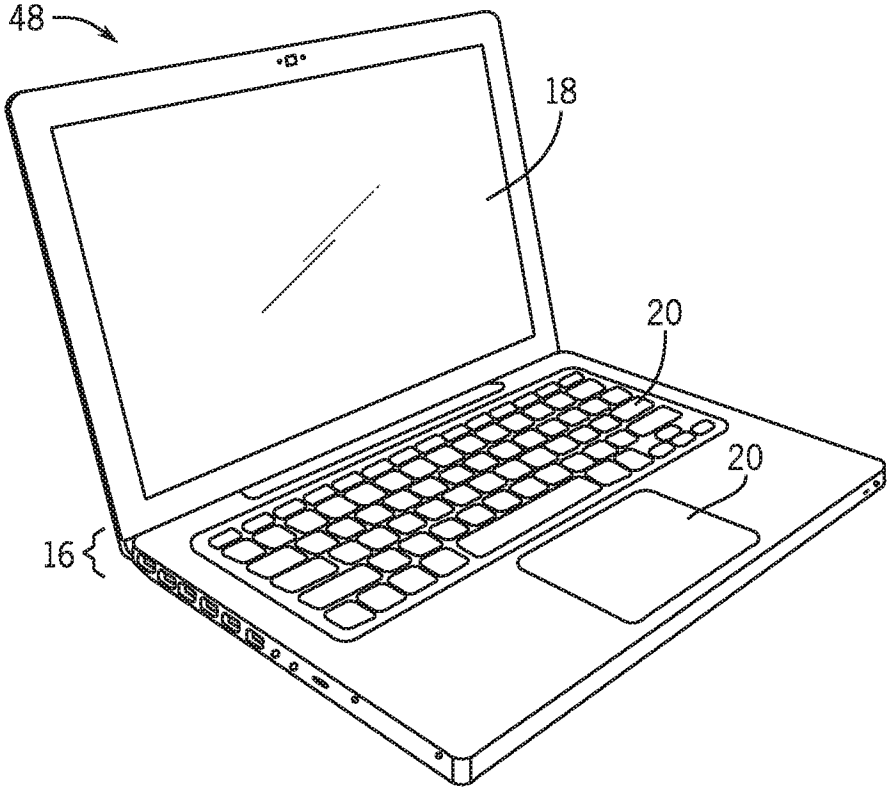
FIG. 4 is a front view of a computer representing an embodiment of the electronic device of FIG. 1, in accordance with an embodiment.

FIG. 4 illustrates a computer 48, which represents another form that the electronic device 10 may take. For illustrative purposes, the computer 48 may be any Macbook® or iMac® model available from Apple Inc. It should be appreciated that the electronic device 10 may also take the form of any other computer, including a desktop computer. The computer 48 shown in FIG. 4 includes the display 18 and input structures 20 that include a keyboard and a track pad. Communication interfaces 16 of the computer 48 may include, for example, a universal service bus (USB) connection.

Figure 5:
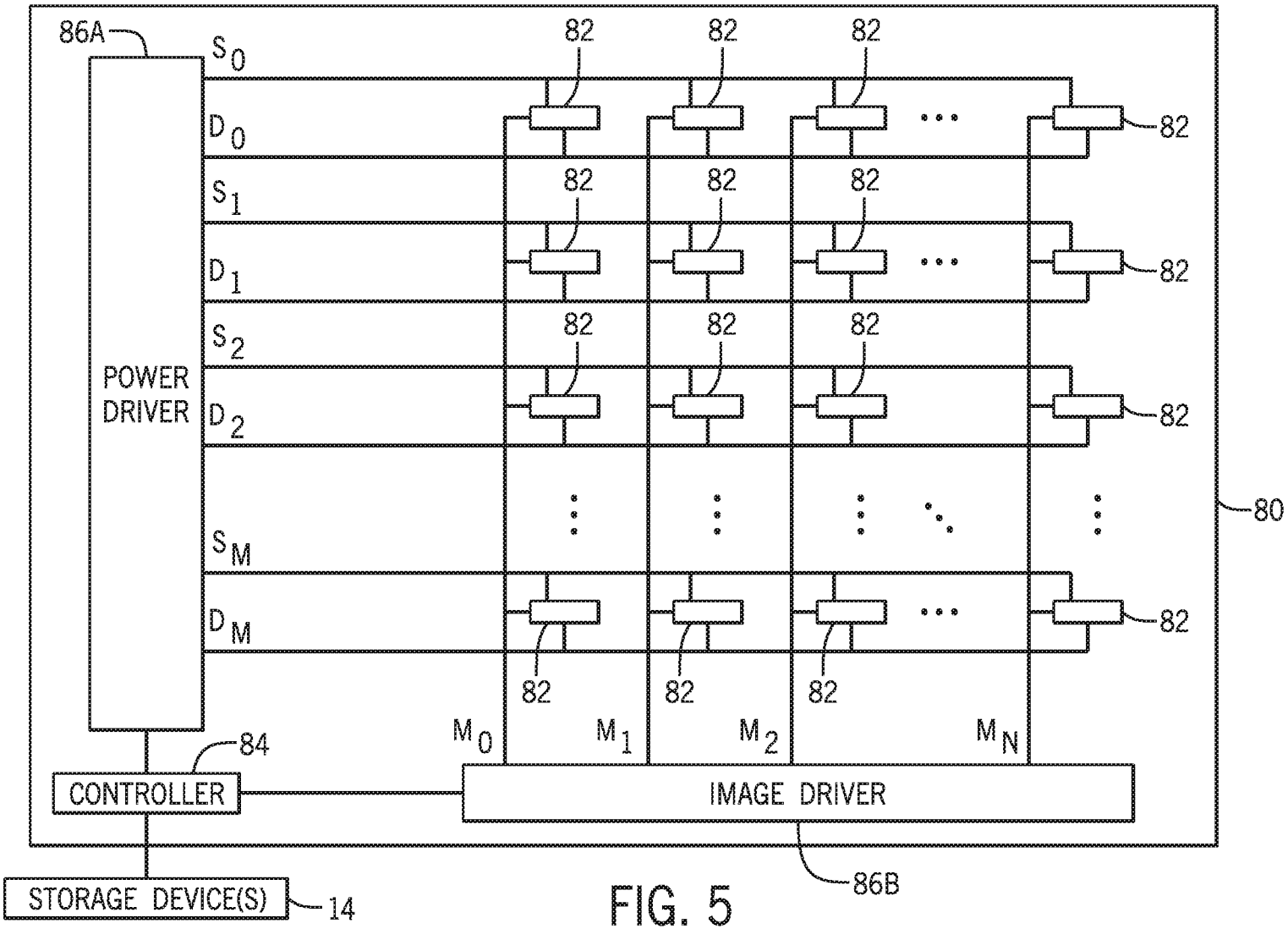
FIG. 5 is a circuit diagram of the display of the electronic device of FIG. 1, in accordance with an embodiment.

As shown in FIG. 5, the display 18 may include a pixel array 80 having an array of one or more pixels 82. The display 18 may include any suitable circuitry to drive the pixels 82. In the example of FIG. 5, the display 18 includes a controller 84, a power driver 86A, an image driver 86B, and the array of the pixels 82. The power driver 86A and image driver 86B may drive individual of the pixels 82. In some embodiments, the power driver 86A and the image driver 86B may include multiple channels for independent driving multiple of the pixel 82. Each of the pixels 82 may include any suitable light emitting element, such as a LED, one example of which is an OLED. However, any other suitable type of pixel may also be used. Although the controller 84 is shown in the display 18, the controller 84 may be located outside of the display 18 in some embodiments. For example, the controller 84 may be located in the processing core complex 12 in some embodiments.

The scan lines S0, S1, . . . , and Sm and driving lines D0, D1, . . . , and Dm may connect the power driver 86A to the pixel 82. The pixel 82 may receive on/off instructions through the scan lines S0, S, . . . , and Sm and may generate programming voltages corresponding to data voltages transmitted from the driving lines D0, D1, . . . , and Dm. The programming voltages may be transmitted to each of the pixel 82 to emit light according to instructions from the image driver 86B through driving lines M0, M1, . . . , and Mn. Both the power driver 86A and the image driver 86B may be transmitted voltage signals at programmed voltages through respective driving lines to operate each pixel 82 at a state determined by the controller 84 to emit light. Each driver may supply voltage signals at a duty cycle and/or amplitude sufficient to operate each pixel 82.

The intensities of each of the pixels 82 may be defined by corresponding image data that defines particular gray levels for each of the pixels 82 to emit light. A gray level indicates a value between a minimum and a maximum range, for example, 0 to 255, corresponding to a minimum and maximum range of light emission. Causing the pixels 82 to emit light according to the different gray levels causes an image to appear on the display 18. In this way, a first brightness of light (e.g., at a first luminosity and defined by a gray level) may emit from a pixel 82 in response to a first value of the image data and the pixel 82 may emit a second brightness of light (e.g., at a first luminosity) in response to a second value of the image data. Thus, image data may create a perceivable image output through indicating light intensities to apply to individual pixels 82.

The controller 84 may retrieve image data stored in the storage device(s) 14 indicative of light intensities for the colored light outputs for the pixels 82. In some embodiments, the processing core complex 12 may provide image data directly to the controller 84. The controller 84 may control the pixel 82 by using control signals to control elements of the pixel 82. The pixel 82 may include any suitable controllable element, such as a transistor, one example of which is a metal-oxide-semiconductor field-effect transistor (MOSFET). However, any other suitable type of controllable elements, including thin film transistors (TFTs), p-type and/or n-type MOSFETs, and other transistor types, may also be used.

Figure 6:
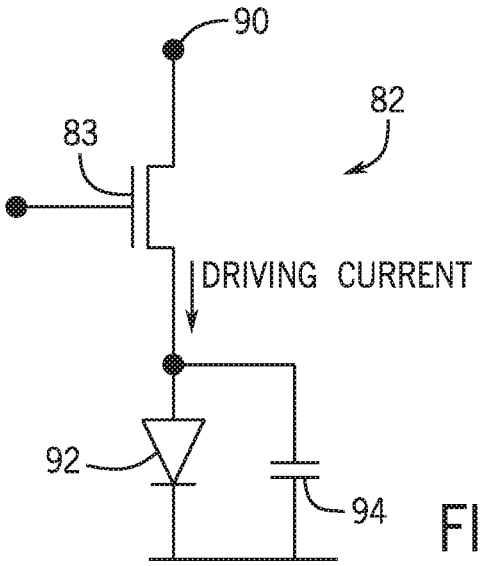
FIG. 6 is a circuit diagram of a pixel of the display of FIG. 5, in accordance with an embodiment.

FIG. 6 illustrates an example of the described pixel 82. The pixel 82 in FIG. 6 may include a terminal 90 to receive a driving current generated in response to a programming voltage based at least in part on the image data to be displayed. The controller 84 may use the programming voltage in conjunction with control signals transmitted to controllable elements of the pixel 82 to control the light emitted from the pixel 82. The programming voltage may correspond to the luminosity (e.g., level of light emitted, measure of light emission) of a light-emitting diode (LED) 92 (e.g., an organic light emitting diode (OLED)) of the self-emissive pixel 82. The programming voltage is applied to a transistor 83, which causes a driving current to be transmitted through the transistor 83 onto the LED 92 based on current-voltage (I-V) characteristics of the transistor 83 (and/or the LED 92). The transistor 83 may be any suitable transistor, such as an oxide thin film transistor in one example. In this way, the light emitted from the LED 92 may be selectively controlled. When the I-V characteristics differ between two pixels 82, perceived brightness of different pixels 82 may appear non-uniform—meaning that one pixel 82 may appear as brighter than a different pixel 82 even when both are programmed by the same programming voltage. The controller 84 or the processing core complex 12 may compensate for these non-uniformities if the controller 84 or the processing core complex 12 are able to accurately predict the I-V behavior of the pixel 82. If the controller 84 or the processing core complex 12 are able to make the prediction, the controller 84 or the processing core complex 12 may determine what programming voltage to apply to the pixel 82 to create the proper current, thereby compensating for differences in the brightness of light emitted between pixels 82. Also depicted in FIG. 6 is a parasitic capacitance 94 of the LED 92. In some embodiments, a leakage current of the transistor 83 may continuously charge an anode of the LED 92 (e.g., the parasitic capacitance 94) such that the anode voltage approaches a turn-on voltage (e.g., a threshold voltage) for the LED 92. Once the anode voltage is equal to or greater than the turn-on voltage for the LED 92, the LED 92 emits light based on the value of driving current transmitted through the LED 92.

Figure 7:
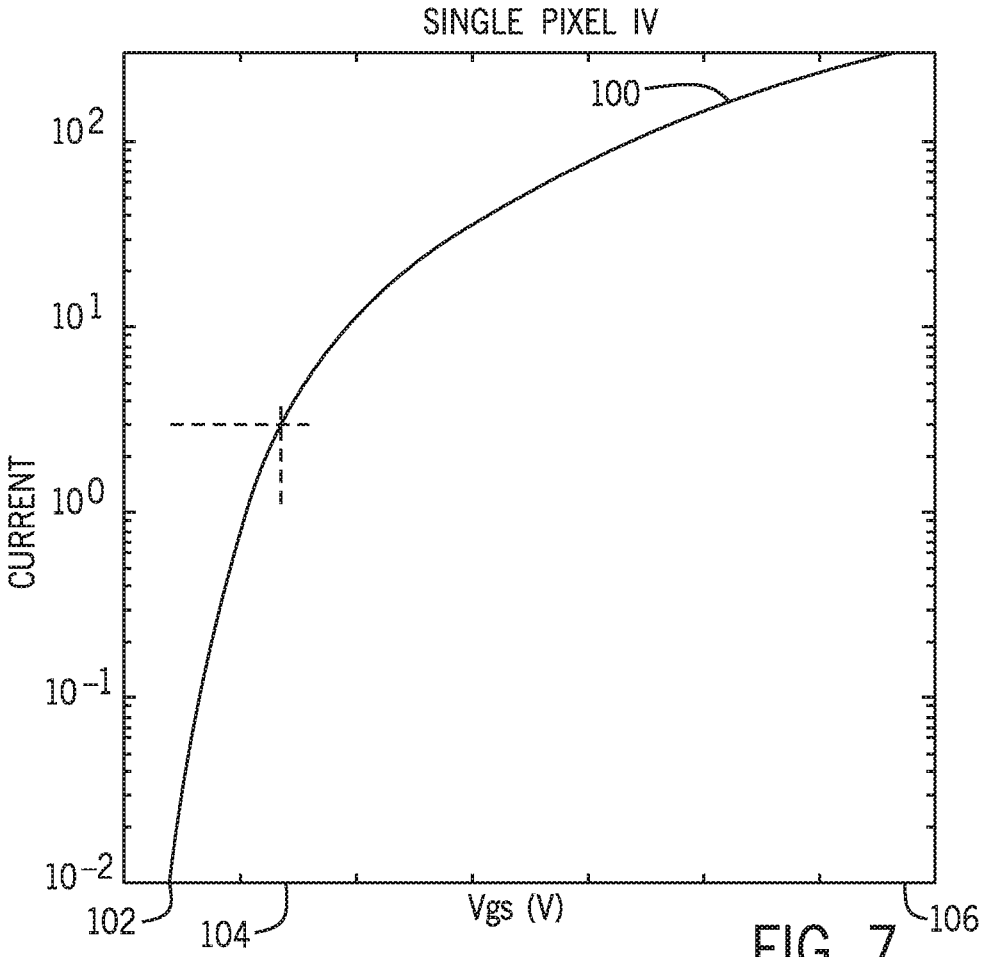
FIG. 7 is a graph of a current versus voltage relationship (I-V curve) corresponding to the pixel of FIG. 6, in accordance with an embodiment.

FIG. 7 is a graph of an I-V curve 100 of a pixel 82, which shows an example of a relationship between the programming voltage applied to the pixel 82 and the current transmitted through the pixel 82 caused by the voltage. Generally, the I-V curve 100 is affected by material properties and/or electrical properties of certain components of the pixel 82, including, for example, the LED 92 and/or the transistor 83. The I-V curve 100 shows a faster increase in current output value from a voltage 102 to a voltage 104 than from the voltage 104 to a voltage 106. The slope associated with the increase in value from the voltage 102 to the voltage 104 appear to vary from the slope associated with the increase in value from the voltage 104 to the voltage 106, meaning that the voltage-to-current relationship of the pixel 82 changes as different voltage values are applied to the pixel 82.

Figure 8:
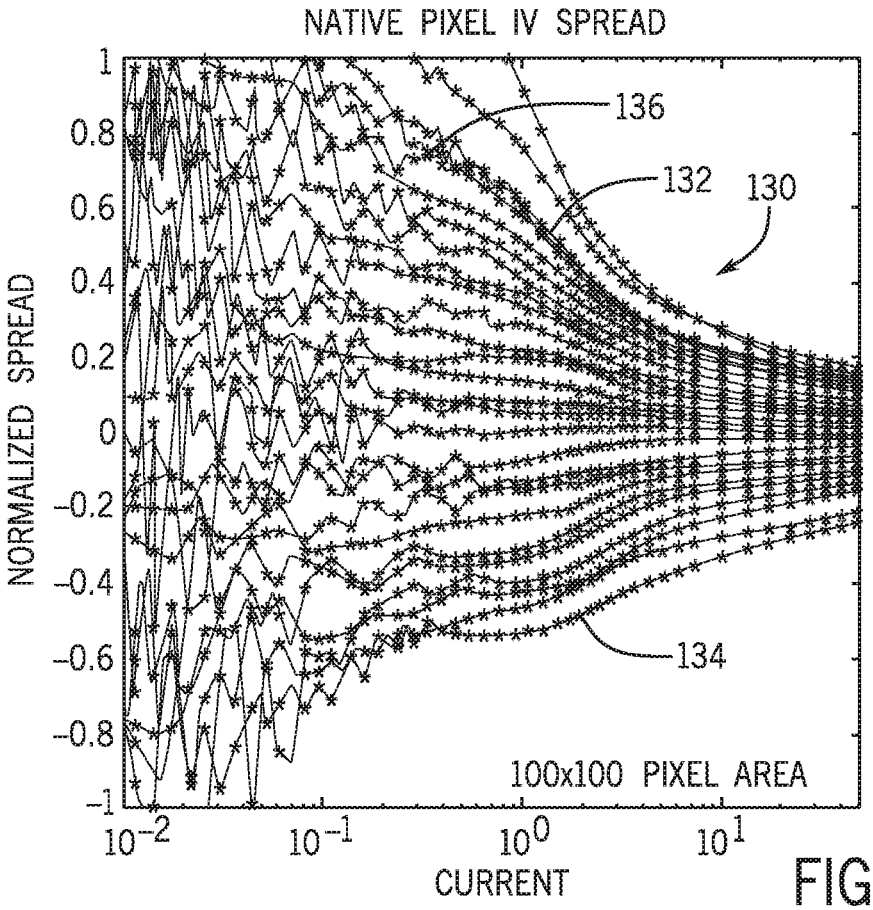
FIG. 8 is a graph of a native spread associated with multiple normalized I-V curves corresponding to the display of FIG. 5, in accordance with an embodiment.

To help illustrate the variance of I-V curves 100 between the pixels 82 of the display 18, FIG. 8 is a graph showing a native spread of simulated I-V curves 130 for a one hundred pixel 82 by one hundred pixel 82 area of the display 18. The graph of FIG. 8 shows normalized values for the I-V curves 130, where it can be seen that individual I-V curves of the I-V curves 130 vary substantially. For example, I-V curve 132 is not equivalent to I-V curve 134, but rather is closer to I-V curve 136. Differences may increase at lower driving currents.

Figure 9:
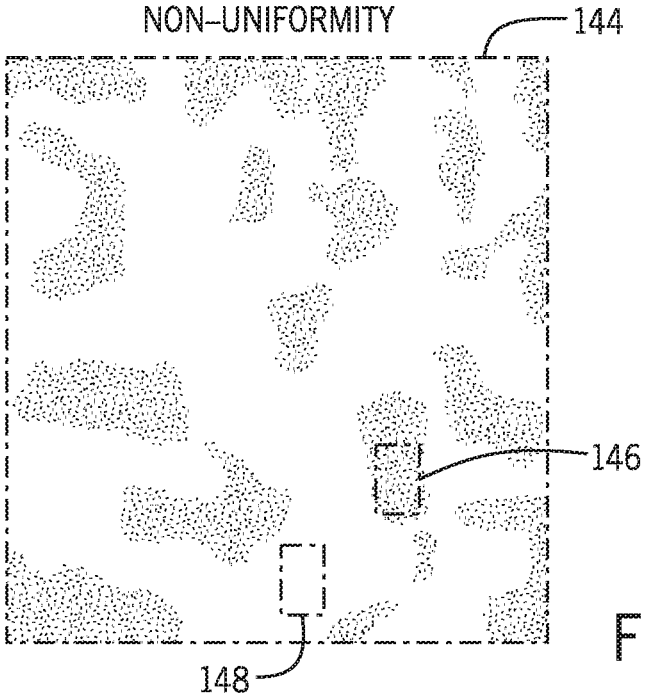
FIG. 9 is an illustration of non-uniformity between pixels of the display of FIG. 5 corresponding to the multiple normalized I-V curves of FIG. 8, in accordance with an embodiment.

FIG. 9 shows how these differences may manifest as visual artifacts on the display 18. This representation of a display panel 144 of the display 18 shows non-uniformities between I-V curves 100 of the pixels 82. For example, portion 146 is perceived as different, or non-uniform, from portion 148. This visual non-uniformity may be caused by material differences in transistors (e.g., the transistor 83 or other transistors in a pixel 82).

Thus, as shown in FIG. 7, FIG. 8, and FIG. 9, a compensation may be applied to more accurately account for varying I-V characteristics among pixels 82. To perform this compensation, the controller 84 or the processing core complex 12 may use an approximation of the I-V curve of the pixel 82. The controller 84 or the processing core complex 12, using the approximation of the I-V curve 100, may identify a proper programming voltage given a desired target current. Thus, when properly compensated, two pixels 82 intended to be driven at the same gray level may receive different programming voltages that result in the same driving current. For example, a first pixel 82 may generate a current of a first value in response to a first voltage applied and a second pixel 82 may generate a current of the same first value in response to a second voltage applied, where the difference between the first and the second voltages account for the non-uniformities between pixels 82.

The controller 84 or the processing core complex 12 may perform an additional adjustment to account for regional or global inaccuracies in the approximations of the I-V curves. This additional adjustment may involve a regional or global I-V adjustment function to determine what adjustment to perform to the driving signal to cause the pixel 82 to compensate for these regional or global differences, and thus cause uniform light emission.

As briefly described above, the relationship between the voltage input and the current output, and vice-versa for use in a pixel 82, at higher voltages and currents may be more predictable and straightforward to approximate. Because the I-V curve may be defined as a function, just a few data points, or variables, may be used to represent the I-V relationship. And indeed, referring back to FIG. 7, the higher voltage and current ranges associated with the voltage 104 to the voltage 106 may be readily approximated by a suitable function (e.g., a linear regression, a power law model, an exponential model). However, at the lower voltage range associated with the portion of the I-V curve 100 between the voltage 102 and the voltage 104, approximations using certain functions may become less accurate.

Figure 10:
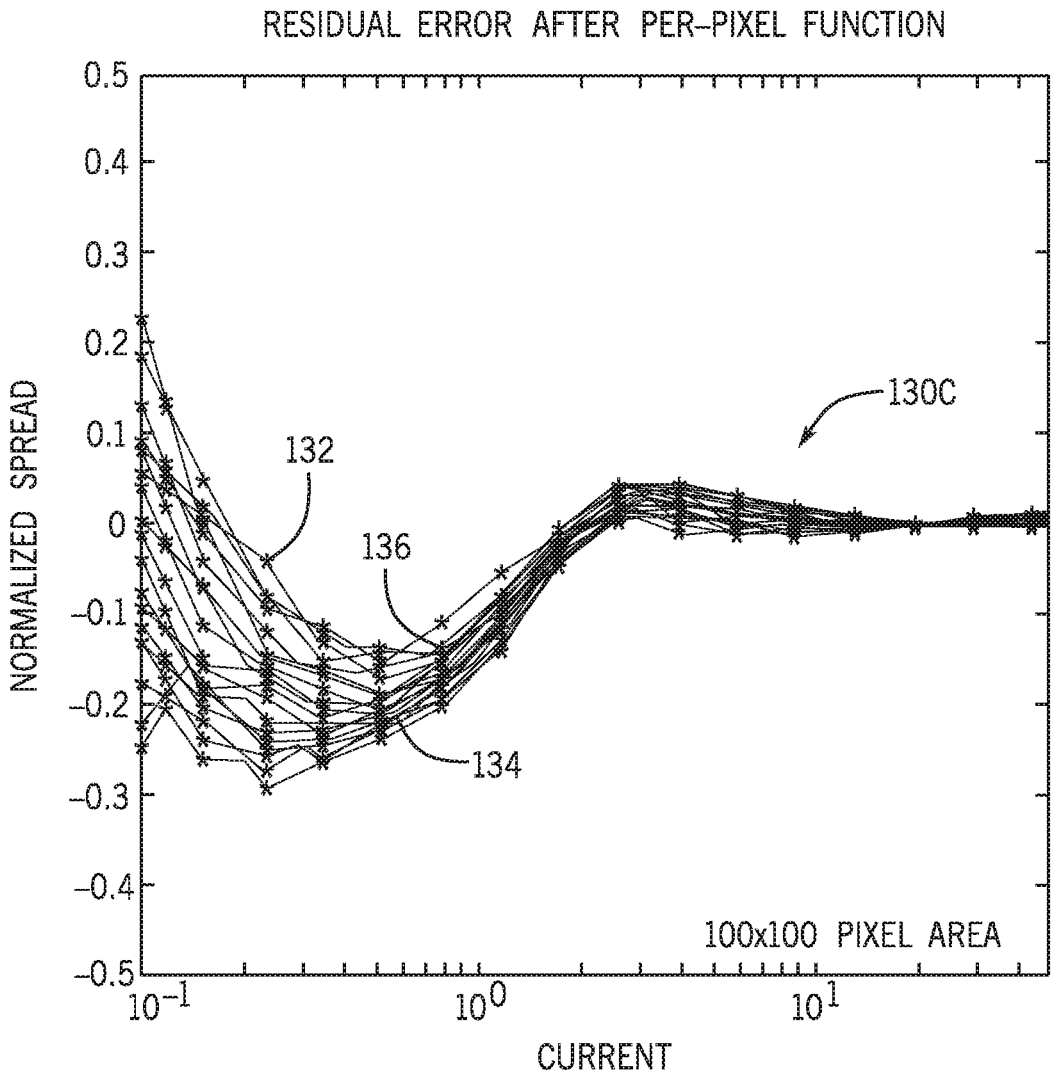
FIG. 10 is a graph of residual error of the native spread associated with the multiple normalized I-V curves of FIG. 8 after applying a per-pixel function, in accordance with an embodiment.

This effect is shown in FIG. 10. FIG. 10 is a graph of the effect of using a per-pixel function on the simulated I-V curves 130 for the one hundred pixels 82 by one hundred pixel 82 area of the display 18 to generate corrected I-V curves 130C of the pixels 82. The immediate improvement to the normalized spread between the corrected I-V curves 130C is clear, for example, in that the variance of the normalized spread between the I-V curves 130 has been reduced from a range extending greater than 1 to −1 to a range extending from approximately 0.25 to −0.3. Furthermore, as an example, the variance between the I-V curve 132 and the I-V curve 134 is lower after implementing the per-pixel function curve fitting for compensation and the I-V curve 132 continues to be similar to the I-V curve 136. The corrected I-V curves 130C show overall how less variance occurs between I-V curves of the separate pixels 82 after implementing the per-pixel function to predict individual pixel 82 behavior in response to different voltages applied. In other words, FIG. 8 shows the variance between respective behaviors of the pixels 82 before the per-pixel function and/or compensation techniques in general are used and FIG. 10 shows the variance after the per-pixel function and/or the compensation techniques are used.

Figure 11A:
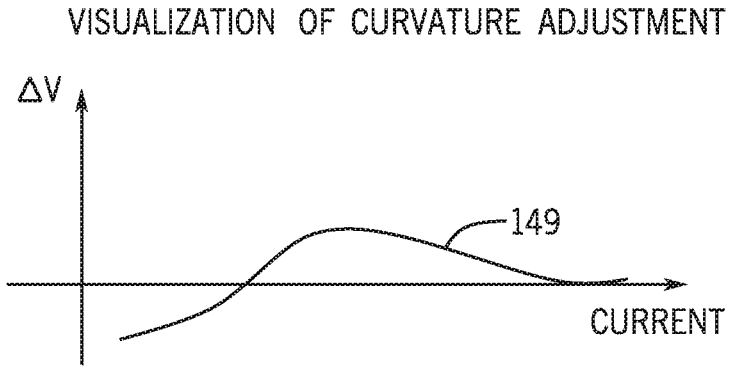
FIG. 11A is a graph of the I-V curve of FIG. 7 before curve fitting, in accordance with an embodiment.
Figure 11B:
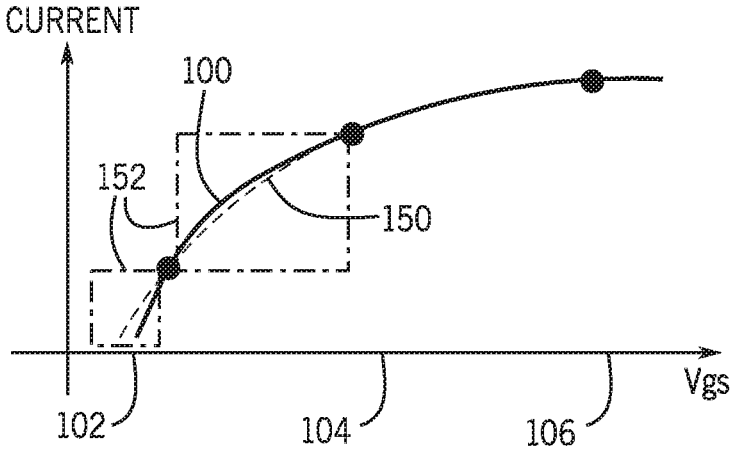
FIG. 11B is a graph of the I-V curve of FIG. 7 after curve fitting and including a depiction of a fitting error associated with the curve fitting, in accordance with an embodiment.

Despite improvements in performance shown with the corrected I-V curves 130C, the average corrected I-V curve 130C may still be less accurate at certain driving currents than may be desired. FIG. 11A is a graph showing a regional or global I-V adjustment 149, representing a difference between an actual I-V curve and an approximation of an I-V curve for a given pixel 82. The curvature adjustment 149 may be visualized in FIG. 11B, which represents a graph showing the I-V curve 100 (representing an actual I-V curve of a pixel 82) compared to a per-pixel function curve 150 (representing an approximation of the I-V curve as defined by a function, as discussed further below with reference to FIG. 12). Thus, the curvature adjustment 149 may be applied to the per-pixel function curve 150 to more accurately approximate the actual I-V curve 100 of a given pixel 82 (see boxes 152).

Figure 12:
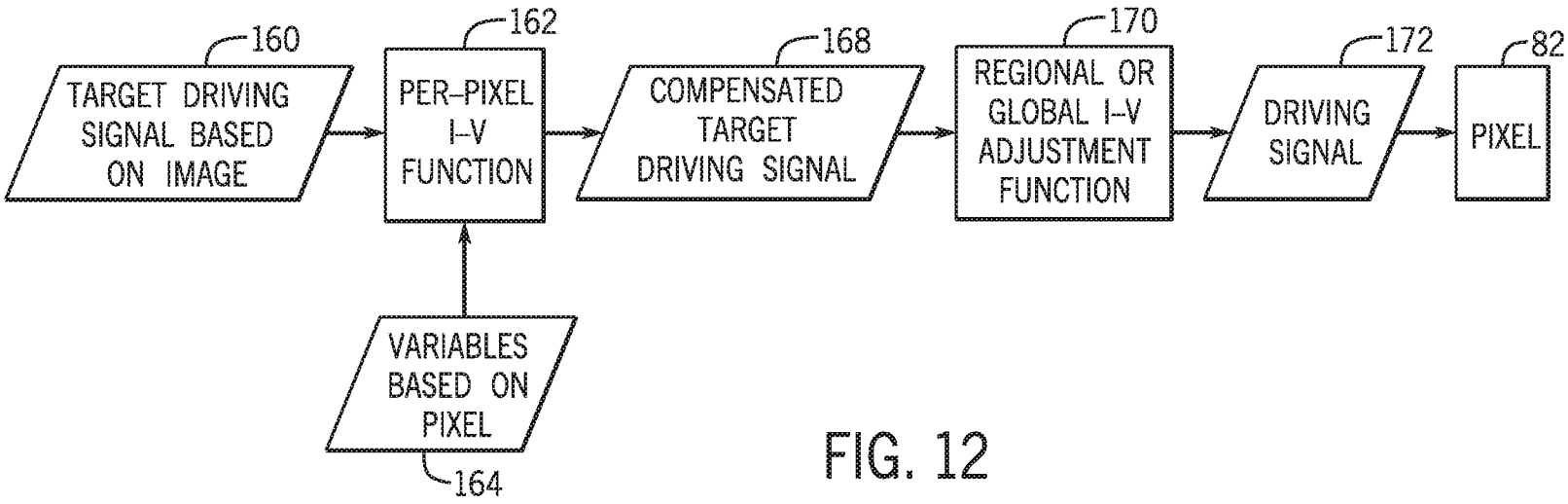
FIG. 12 is a block diagram of applying a per-pixel function and a regional or global adjustment function to correct an electrical signal used to drive the pixel of FIG. 6 to compensate for pixel non-uniformity, in accordance with an embodiment.

To better explain how the controller 84 or the processing core complex 12 may compensate for I-V non-uniformity among pixels, FIG. 12 is a block diagram illustrating the application of a per-pixel function and a regional or global adjustment function to a target driving signal 160. A variety of suitable components of the electronic device 10 may be used to perform the adjustments, including but not limited to, hardware and/or software internal and/or external to the display 18 (e.g., the controller 84 or the processing core complex 12). Furthermore, the target driving signal 160 may be a gray level, a voltage value, or a driving current value based on the image data to be displayed on the display panel 144.

In general, the controller 84 or the processing core complex 12 may apply the target driving signal 160 to a per-pixel I-V function 162 that receives the target driving signal 160 and one or more variables 164 (variables based on the pixel 82). The per-pixel I-V function 162 may be any suitable function that generally describes the I-V characteristics of each respective pixel 82. The per-pixel I-V function 162 may be, for example, a linear regression, a power law model (e.g., current equals power multiplied by a voltage difference exponentially raised by an exponent constant representative of the slope between the voltage 104 to the voltage 106), an exponential model, or the like. The variables 164 may be values stored in memory (e.g., in one or several look-up tables). When the used in the function, the variables 164 allow the per-pixel I-V function 162 to produce a first form of compensation for pixel values by, for example, translating the target driving signal (e.g., a target driving current signal) to a corresponding programming value (e.g., a programming voltage). This is shown in FIG. 12 as a compensated target driving signal 168, which may represent the programming voltage for the pixel 82 that is intended to achieve a target driving current across the LED 92 of the pixel 82.

As mentioned above, however, this first per-pixel I-V function 162 may not always, on its own, provide a complete compensation. Indeed, the per-pixel I-V function 162 may produce an approximation of the I-V curve of the pixel 82 based on a reduced number of variables 164. Thus, rather than define the I-V curve of the pixel 82 using numerous measured data points, the I-V curve of the pixel 82 may be approximated using some limited number of variables 164 that may generally define the I-V curve. Using the example of the power law model, the variables 164 may represent a coefficient, an exponent constant, and a voltage component; however, different functions may involve different variables. For example, coefficients that define a polynomial and/or an exponential function that approximates the I-V curve may be used. The stored variables 164 may be determined based on measurements of the pixels 82 during manufacturing or based on measurements that are sensed using any suitable sensing circuitry in the display 18 to identify the I-V characteristics of each pixel 82.

Since the per-pixel I-V function 162 provides an approximation of an actual I-V curve of a pixel 82, the resulting compensated target driving signal 168 may be further compensated. The controller 84 or the processing core complex 12 may apply a regional or global adjustment function 170 that provides a correction factor that may represent, for example, a curvature adjustment such as that shown in FIG. 11A. In effect, the regional or global adjustment function 170 may specify a voltage difference, given the desired target driving current, to apply to all programming voltage values obtained based on the per-pixel I-V function 162 in a given spatial region of pixels or color channel of pixels (or globally across all pixels of the display 18). This may produce a driving signal 172 (e.g., a programming voltage) that may be used to program the pixels 82.

Figure 13:
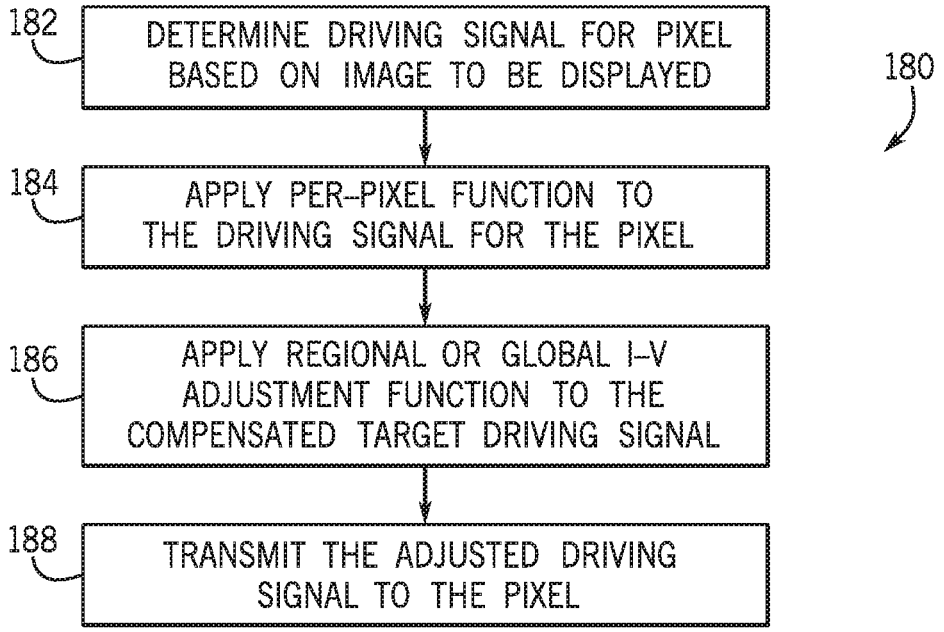
FIG. 13 is a flowchart of a process for performing the per-pixel function and the regional or global adjustment function of FIG. 12, in accordance with an embodiment.

FIG. 13 is a flowchart a process 180 for performing the per-pixel function and the positional compensation of FIG. 12 that the controller 84 may follow in operating to correct for non-uniformities of the display panel 144. The process 180 of FIG. 13 includes determining a driving signal for a pixel based on image to be displayed (block 182), applying a per-pixel function to the driving signal for the pixel (block 184), applying a regional or global adjustment function to the modified driving signal for the pixel (block 186), and transmitting the adjusted driving signal to the pixel (block 188).

Figure 14:
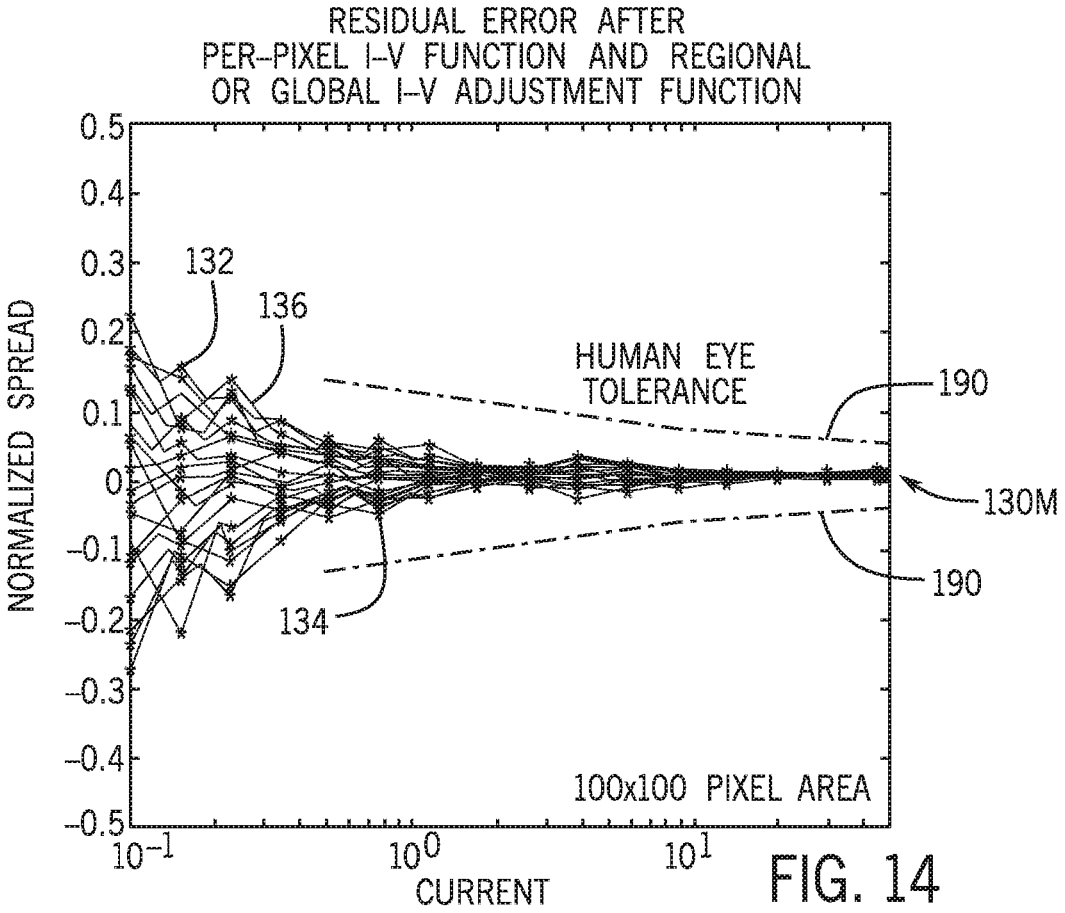
FIG. 14 is a graph of the residual error of the native spread associated with the multiple normalized I-V curves of FIG. 10 after implementation of the per-pixel function and the regional or global adjustment function, in accordance with an embodiment.

FIG. 14 is a graph showing the effect of implementing these described compensation techniques to electrical signals in a display 18. The graph includes modified I-V curves 130M based on the original I-V curves 130 after having undergone modifications based at least in part on the per-pixel I-V function 162, the curvature adjustments modifying the per-pixel I-V function 162, and the regional or global adjustment function 170. Comparing FIG. 14 to FIG. 10 highlights the improvements to the normalized error between the different I-V curves 130 associated with the display panel 144. The minimum and maximum normalized error are improved from applying the functions to range from approximately 0.25 to −0.25 (a decrease from previously 0.25 to −0.3) in addition to the smoothing out of the overall response shape of the error associated with the modified I-V curves 130M. In addition, the effect from using these compensation techniques is that now any error remaining after compensation may be unperceivable to a viewer. If an error extends beyond human eye tolerance boundaries 190, a viewer may be able to detect a non-uniformity between the pixels 82 (e.g., as depicted in FIG. 9). Because the normalized spread is now contained within human eye tolerance boundaries 190, no perceivable non-uniformities are created from I-V curve 100 inconsistencies compensated via the described functions.

Thus, the technical effects of the present disclosure include improving controllers of electronic displays to compensate for pixel non-uniformities, for example, by applying a per-pixel function and a regional or global adjustment function to electrical signals used in driving a pixel to emit light. These techniques describe selectively adjusting electrical signals used to drive a pixel to emit light at a particular brightness of light to account for specific properties of that pixel different from other pixels by applying the per-pixel function to perform the compensation. The per-pixel function may use variables to define the specific properties of the pixel instead of relying on large amounts of data gathered to define the specific properties of the pixel. These techniques additionally describe a regional or global adjustment function that compensates for inaccuracies of the per-pixel function that may apply to pixels in a region or globally across the display.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system comprising:

an electronic display comprising a plurality of pixels, wherein each pixel of the plurality of pixels comprises respective driving circuitry that supplies a respective driving current to a respective light-emitting diode based on a respective program voltage applied to the respective driving circuitry, and wherein the respective driving circuitry generates the respective driving current according to respective pixel current-voltage (I-V) curves that vary from pixel to pixel; and processing circuitry configured to:

receive image data;

retrieve, from a memory, stored approximations of the respective pixel current-voltage (I-V) curves as defined by a first function and based at least in part on a correction factor comprising a second function that varies its output in response to changes in current values; and determine a signal indicative of the respective program voltage for each pixel of the plurality of pixels based at least in part on the approximations of the respective pixel current-voltage (I-V) curves and the image data, wherein the approximations of the respective pixel current-voltage (I-V) curves are defined at least partially before receiving the image data.

2. The system of claim 1, wherein the first function is specific to each pixel of the plurality of pixels and associates a target driving voltage indicated by the image data to the respective program voltage.

3. The system of claim 2, wherein the first function comprises a linear regression, a power law model, an exponential model, or some combination thereof.

4. The system of claim 1, wherein the correction factor is specific to a subset of the plurality of pixels.

5. The system of claim 4, wherein the subset of the plurality of pixels comprises pixels of a spatial region.

6. The system of claim 4, wherein the subset of the plurality of pixels comprises pixels of a particular color channel.

7. The system of claim 1, wherein the correction factor is global to all of the plurality of pixels of the electronic display.

8. The system of claim 1, wherein the respective driving circuitry comprises a transistor.

9. The system of claim 8, wherein the transistor comprises an oxide thin film transistor.

10. A method for compensating for non-uniformities of an electronic display, comprising:

receiving, using processing circuitry, image data to be displayed on the electronic display;

determining, using the processing circuitry, a target driving signal for a first pixel of the electronic display based at least in part on the image data to be displayed;

applying, using the processing circuitry, a per-pixel current-voltage (I-V) function approximating a current-voltage (I-V) curve of the first pixel to obtain a modified driving signal;

applying, using the processing circuitry, a correction factor to obtain an adjusted driving signal from the modified driving signal, wherein the correction factor comprises a curvature adjustment function that compensates for approximation errors in the per-pixel current-voltage (I-V) function based on the target driving signal to obtain the adjusted driving signal from the modified driving signal; and causing the electronic display to drive the first pixel based at least in part on the adjusted driving signal.

11. The method of claim 10, wherein the per-pixel current-voltage (I-V) function comprises a linear regression, a power law model, an exponential model, or some combination thereof, and wherein a variable to be used to define the per-pixel current-voltage (I-V) function is retrieved from a memory after the determination of the target driving signal.

12. The method of claim 10, wherein the target driving signal is a target driving current, wherein the per-pixel current-voltage (I-V) function uses the target driving current to obtain the modified driving signal, and wherein the modified driving signal comprises a pixel program voltage.

13. The method of claim 12, wherein the curvature adjustment function is used to determine a voltage difference to apply to the modified driving signal based at least in part on the target driving current to obtain the adjusted driving signal, and wherein the adjusted driving signal comprises an adjusted pixel program voltage.

14. The method of claim 10, wherein the curvature adjustment function is applied to modified driving signals for pixels in a particular spatial region of the electronic display to reduce non-uniformity relative to another spatial region of the electronic display.

15. The method of claim 10, wherein the curvature adjustment function is applied to all pixels in the electronic display.

16. An article of manufacture comprising one or more tangible, non-transitory, machine-readable media storing instructions executable by one or more processors of an electronic device, wherein the instructions comprise instructions to:

receive image data to be displayed on an electronic display;

determine a target driving signal for a first pixel of the electronic display based at least in part on the image data to be displayed;

apply a per-pixel current-voltage (I-V) function approximating a current-voltage (I-V) curve of the first pixel to obtain a modified driving signal;

adjust the modified driving signal based at least in part on a regional or global current-voltage (I-V) curvature adjustment function to obtain an adjusted driving signal, wherein the regional or global current-voltage (I-V) curvature adjustment function compensates for an expected approximation error in the per-pixel current-voltage (I-V) function when the first pixel is driven using the modified driving signal to obtain the adjusted driving signal; and cause the electronic display to drive the first pixel based at least in part on the adjusted driving signal.

17. The article of manufacture of claim 16, wherein the per-pixel current-voltage (I-V) function comprises a linear regression, a power law model, an exponential model, or some combination thereof.

18. The article of manufacture of claim 16, wherein the target driving signal is a target driving current, wherein the per-pixel current-voltage (I-V) function uses the target driving current to obtain the modified driving signal, and wherein the modified driving signal comprises a pixel program voltage.

19. The article of manufacture of claim 16, wherein the regional or global current-voltage (I-V) curvature adjustment function is applied to modified driving signals corresponding to pixels in a particular spatial region of the electronic display.

20. The article of manufacture of claim 16, wherein the regional or global current-voltage (I-V) curvature readjustment function is applied to modified driving signals for all pixels in the electronic display.

* * * * *